US007436314B2

(12) United States Patent
Haider et al.

(10) Patent No.: US 7,436,314 B2
(45) Date of Patent: Oct. 14, 2008

(54) MONITOR AND CIRCUIT ARRANGEMENT FOR VOLTAGE REGULATOR

(75) Inventors: Gunter Haider, Linz (AT); Gerhard Nebel, Immenstadt (DE); Iker San Sebastian, Munich (DE); Holger Sedlak, Sauerlach (DE); Uwe Weder, Hallertau (DE)

(73) Assignee: Infineon Technologies (DE)

( * ) Notice: Subject to any disclaimer, the term of this patent is extended or adjusted under 35 U.S.C. 154(b) by 326 days.

(21) Appl. No.: 11/305,821

(22) Filed: Dec. 16, 2005

(65) Prior Publication Data

US 2006/0192681 A1 Aug. 31, 2006

Related U.S. Application Data

(63) Continuation of application No. PCT/DE2004/001105, filed on May 28, 2004.

(30) Foreign Application Priority Data

Jun. 17, 2003 (DE) ..... 103 27 285

(51) Int. Cl.
*G08B 21/00* (2006.01)

(52) U.S. Cl. ..... 340/661; 340/660; 340/511; 324/72.5

(58) Field of Classification Search ..... 340/660–664, 340/635, 667, 657, 693.1, 693.4, 511; 324/72.5; 327/50; 361/18

See application file for complete search history.

(56) References Cited

U.S. PATENT DOCUMENTS

| | | | | |
|---|---|---|---|---|
| 3,641,546 | A | 2/1972 | Blackburn | |
| 4,020,414 | A | 4/1977 | Paredes | |
| 4,461,003 | A * | 7/1984 | Tamaki | 714/22 |
| 4,559,497 | A | 12/1985 | Farrugia | |
| 5,373,227 | A * | 12/1994 | Keeth | 323/313 |
| 5,721,937 | A * | 2/1998 | Kurihara et al. | 713/323 |
| 5,831,419 | A * | 11/1998 | Casper | 323/274 |
| 5,963,023 | A | 10/1999 | Herrell et al. | |
| 6,300,820 | B1 * | 10/2001 | Fotouhi et al. | 327/536 |
| 6,316,988 | B1 * | 11/2001 | Forehand et al. | 327/538 |
| 2002/0135339 | A1 | 9/2002 | Tang et al. | |

FOREIGN PATENT DOCUMENTS

EP 0 030 980 B1 11/1984

* cited by examiner

*Primary Examiner*—George A Bugg
*Assistant Examiner*—Hoi C Lau
(74) *Attorney, Agent, or Firm*—Dickstein, Shapiro, LLP.

(57) ABSTRACT

A circuit arrangement having a voltage regulator, which is designed to generate a regulated operating voltage, and a voltage monitoring unit, which is designed to monitor the regulated operating voltage for deviations from desired values. The voltage monitoring unit has a first detector, which is designed to cause an alarm signal to be generated when the first detector detects that the regulated operating voltage is outside a first voltage interval, and a second detector, which is designed to cause an initiator to initiate countermeasures which influence the regulated operating voltage when the second detector detects that the regulated operating voltage is outside a second voltage interval, which is inside the first voltage interval.

15 Claims, 2 Drawing Sheets

MONITOR AND CIRCUIT ARRANGEMENT FOR VOLTAGE REGULATOR

CROSS-REFERENCE TO RELATED APPLICATION

This application is a continuation of International Patent Application Ser. No. PCT/DE2004/001105, filed May 28, 2004, which published in German on Dec. 29, 2004 as WO 2004/114040, claims priority to German Patent Application No. 10327285.2 filed on Jun. 17, 2003, and is incorporated herein by reference in its entirety.

FIELD OF THE INVENTION

The invention relates to a circuit arrangement having a voltage regulator for generating a regulated operating voltage and a voltage monitoring unit which monitors the regulated operating voltages for deviations from desired values, first detection means of the voltage monitoring unit generating an alarm signal if the operating voltage is outside a first voltage interval.

BACKGROUND OF THE INVENTION

Circuit arrangements of this type are used, for example, in chip cards, particularly chip cards with contacts. A plurality of voltage ranges for the externally applied voltage are prescribed by ISO 7816-3 for such chip cards. Permitted voltage ranges are accordingly 5.0 volts ±10%, 3.0 volts ±10% and 1.8 volts ±10%. Within the chip, the voltage regulator for generating a regulated operating voltage ensures a constant operating voltage of typically 1.5 volts which is suitable for the present technology. Despite the voltage regulator, load fluctuations or fluctuations in the external voltage often make it impossible to keep the operating voltage in the range of 1.5 volts ±10% under all circumstances.

In this case, particular importance is attached to hacker attacks which deliberately manipulate the voltage which is supplied to a chip card in order to disrupt data processing within the chip card, which may result in it being possible to read out data which are intended to be kept secret or to detect internal processing operations which are veiled during normal operation. In order to prevent hacker attacks of this type, provision is made of the voltage monitoring unit which monitors the regulated operating voltage and generates an alarm signal when the prescribed permissible voltage interval is left, said alarm signal preferably resulting in the system being reset. Suitably setting the permissible voltage interval is problematic in this case. On the one hand, this interval must be so small that malfunctions can be guaranteed not to occur, but, on the other hand, the interval must be so large that internal voltage fluctuations during normal operation do not trigger a reset since the system does not operate correctly otherwise.

The permissible voltage interval has hitherto been selected to be so large that no alarm is triggered during normal operation. This led to increased design complexity since the circuit must be guaranteed to operate reliably in this large voltage interval, which is all the more problematic, the lower the operating voltage. Another known measure is to keep load fluctuations as low as possible using a complicated circuit design so that the prescribed voltage limits of the voltage interval do not lead to the alarm in the case of normal load changes. The disadvantage of the two known measures is the increased complexity of the circuit design and the associated increased area requirement of the circuit arrangement.

SUMMARY OF THE INVENTION

A circuit arrangement having a voltage regulator, which is designed to generate a regulated operating voltage, and a voltage monitoring unit, which is designed to monitor the regulated operating voltage for deviations from desired values. The voltage monitoring unit has a first detector, which is designed to cause an alarm signal to be generated when the first detector detects that the regulated operating voltage is outside a first voltage interval, and a second detector, which is designed to cause an initiator to initiate countermeasures which influence the regulated operating voltage when the second detector detects that the regulated operating voltage is outside a second voltage interval, which is inside the first voltage interval.

BRIEF DESCRIPTION OF THE DRAWINGS

The invention will be explained in more detail below with reference to exemplary embodiments. In the drawing:

FIG. 3 shows a more detailed illustration of a circuit arrangement according to the invention in a first exemplary embodiment.

DETAILED DESCRIPTION OF PREFERRED EMBODIMENTS OF THE INVENTION

It is an object of the invention to specify a circuit arrangement which is secure against hacker attacks (resulting from manipulation of the supply voltage supplied) but does not require a complicated circuit design for this purpose.

This object is achieved by means of a circuit arrangement of the type mentioned initially, which circuit arrangement is characterized in that the voltage monitoring unit contains second detection means for detecting whether the regulated operating voltage is outside a second voltage interval which is inside the first voltage interval, and in that provision is made of means for initiating countermeasures which influence the voltage if the operating voltage is outside the second voltage interval.

The advantage of the circuit arrangement according to the invention resides in the fact that, when a limit value is overshot or undershot, the circuit is not reset immediately but rather countermeasures are first of all initiated in order to get close to the voltage desired value again. This is affected if the second, inner voltage interval is left. It is thus possible to compensate for voltage changes which are caused by internal load changes. However, should the disturbance caused by an influence which is generally external be so great that, even when countermeasures are initiated, the voltage continues to run away and also leaves the outer voltage interval, an alarm is triggered, which alarm, as in circuit arrangements from the prior art, may result in the circuit being reset.

Internal voltage fluctuations which may also occur during normal operation and are not yet intended to lead to an alarm may be detected in good time.

In a simple manner, the detection means may be constructed using comparators. In one advantageous refinement, a clock signal of the circuit arrangement is stopped briefly in order to save power and to make it possible for the voltage regulator to provide further charge so that the voltage increases again in the direction of the desired value. Such a reaction occurs if the regulated operating voltage falls below the lower limit of the second voltage interval. If the voltage overshoots the second voltage interval, intervention in the voltage regulator is advantageously affected, which intervention results in the internal voltage falling rapidly. It is thus also possible to compensate for a rapid rise in the supply voltage supplied, which rise cannot be taken into account quickly enough by the normal voltage regulating operation.

Figure 1:
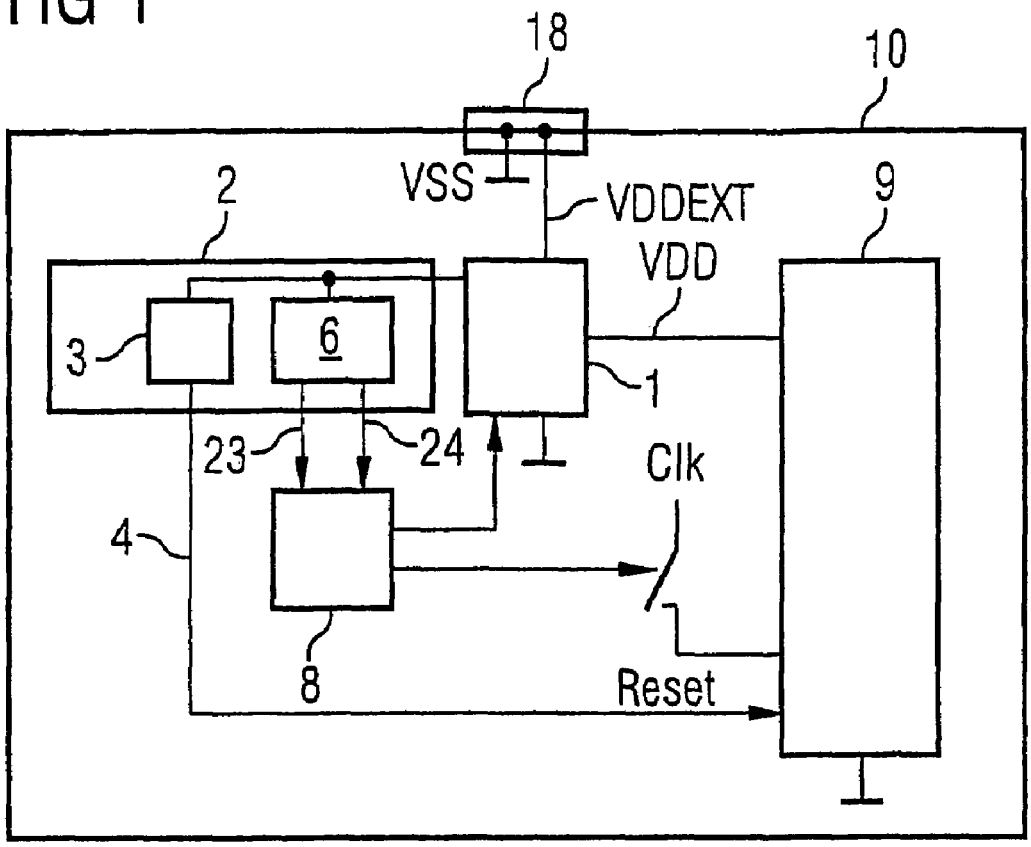
FIG. 1 shows a block diagram of a circuit arrangement according to the invention.

FIG. 1 shows a chip card 10 which has contacts and comprises a circuit arrangement according to the invention. An externally supplied supply voltage VDDext is passed to a voltage regulator 1 via contacts 18. A regulated internal operating voltage VDD which is supplied to further circuit components 9 is generated in the voltage regulator. The regulated operating voltage VDD is monitored by a voltage monitoring unit 2. First detection means 3 of the voltage monitoring unit 2 monitor the operating voltage VDD to determine whether it is inside a first voltage interval 5. When the first voltage interval 5 is overshot or undershot, an alarm signal 4 is generated, the alarm signal causing the further circuit components 9 to be reset in the example shown. Instead of this, other security measures may also be provided, for example the erasure of a memory or else the destruction of circuit components so that the chip card 10 becomes unusable.

In addition, provision is made of second detection means 6 which monitor the operating voltage VDD to determine whether it overshoots or undershoots limits 23 and 24 of a second voltage interval 7. If this is the case, corresponding warning signals SHUT DOWN and CLOCK STOP are generated, which warning signals are supplied to means 8 for initiating countermeasures which influence the voltage. In the exemplary embodiment shown, when the lower limit 24 of the second voltage interval 7 is undershot, a clock signal CLK is interrupted for a short period of time, with the result that the current consumption of the further circuit components 9 falls rapidly and thus relieves the load on the voltage regulator 1. The regulated operating voltage VDD is thus prevented from falling further.

When the upper limit 23 of the second voltage interval 7 is overshot, provision is made, in accordance with the embodiment of FIG. 1, for intervening in the voltage regulator 1 and rapidly lowering the regulator output voltage, that is to say the regulated operating voltage VDD, there. The regulated operating voltage must be changed so quickly that it is also possible to compensate for rapid fluctuations in the external supply voltage VDDext. In this case, compensation is not aimed at a constant operating voltage VDD but rather only at complying with the limits prescribed by the first voltage interval 5. Fine regulation of the operating voltage VDD after the end of the disturbance is then incumbent upon the voltage regulator 1.

Neither internally induced voltage changes nor hacker attacks thus immediately result in a reset but rather the system is at first only slowed down or "manipulated" until the voltage regulator 1 has brought the operating voltage VDD into the inner interval 7 again. However, if the disturbances are so great that these measures do not suffice to keep the voltage in the first voltage interval 5, the first detection means 3 generate an alarm signal 4 which, for its part, can then trigger a reset. From a security-related point of view, the circuit arrangement according to the invention thus does not have any disadvantages in comparison with circuit arrangements from the prior art which have only first detection means, that is say which, when the prescribed voltage interval is left, immediately generate an alarm signal which results in a reset.

Figure 2:
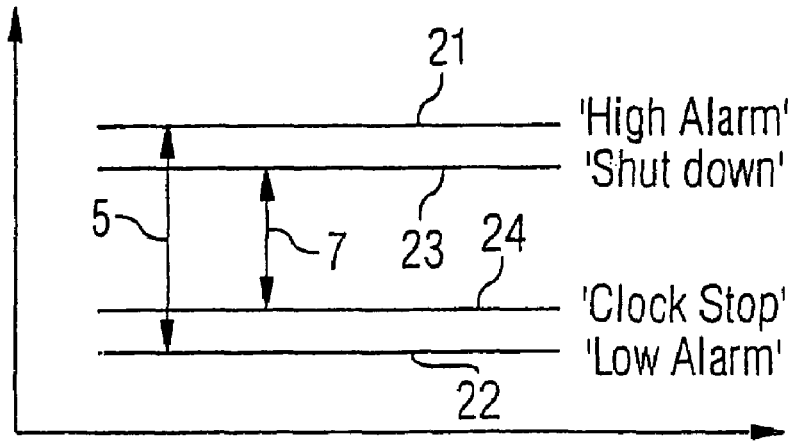

FIG. 2 illustrates the position of the voltage intervals 5 and 7. It is apparent from this figure that the first voltage interval 5 has an upper limit 21 and a lower limit 22. When the upper limit 21 is overshot, an alarm signal HIGH ALARM is triggered, and when the lower limit 22 is undershot, an alarm signal LOW ALARM is triggered. The second voltage interval 7 is inside the first voltage interval 5 and has an upper limit 23 and a lower limit 24. When the upper limit 23 is overshot, a signal SHUT DOWN is triggered, while, when the lower limit 24 is undershot, a signal CLOCK STOP is generated. The difference between the limits 21 and 23 and the limits 24 and 22 does not need to be the same.

Figure 3:
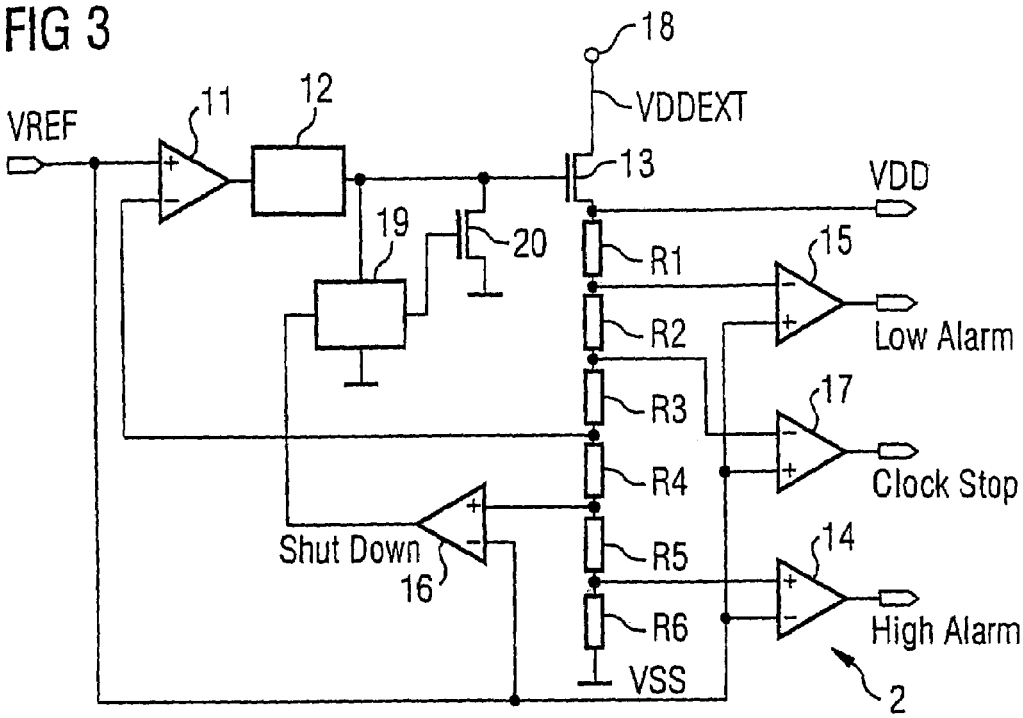
FIG. 3 shows a graph showing the position of the limits of the voltage intervals.

FIG. 3 shows a more detailed illustration of a circuit arrangement according to the invention. During normal operation, the external supply voltage VDDext is regulated in such a manner that a constant operating voltage VDD is generated. To this end, provision is made of a regulating transistor 13 which is driven by a regulator 11 and a voltage pump 12. The voltage pump is intended to raise the drive voltage for the regulating transistor 13 in such a manner that the latter can be fully turned on even if the regulated internal operating voltage VDD is less than the threshold voltage of the transistor 13 under the external supply voltage VDDext.

A reference voltage Vref which forms a desired value and is compared with an actual value is applied to the regulator 11. The voltage monitoring unit 2 is formed by four comparators 14, 15, 16 and 17 which are supplied with, on the one hand, the reference voltage Vref and, on the other hand, comparison voltages. The comparison voltages are generated by a voltage divider R1 . . . R6 which is connected between the regulated operating voltage VDD and a reference ground voltage VSS. The comparators 14, 15, 16 and 17 generate the alarm signals HIGH ALARM and LOW ALARM as well as the warning signals SHUT DOWN and CLOCK STOP.

As long as the regulated operating voltage VDD is inside the second voltage interval 7, all four comparators provide a "0" at their outputs. The output of that comparator 16 which generates the SHUT DOWN signal if the voltage limit 23 is overshot is connected to a so-called level shifter 19. The latter is used to raise the level for driving a transistor 20 to the voltage value of the voltage pump 12. The transistor 20 is connected between the gate of the regulating transistor 13 and the reference ground voltage VSS. If the SHUT DOWN signal is at "0", the output of the level shifter 19 is also at "0" and the transistor 20 is off. A normal operating state is present, in which the voltage regulator comprising the regulator 11, the pump 12 and the regulating transistor 13 performs fine regulation of the voltage.

If the regulated operating voltage VDD overshoots the upper limit 23 of the second voltage interval 7, the comparator 16 switches to "1" and the level shifter 19 supplies the pump voltage to the gate of the transistor 20. This transistor 20 which, in the exemplary embodiment shown, is an MMOS transistor thus becomes a diode and turns on. The source of the transistor 20 is connected to the reference ground potential VSS and therefore dissipates charge from the gate of the regulating transistor 13 in a very rapid manner. The regulating transistor thus acquires high impedance and the voltage VDD falls since no further charge is provided. The voltage falls very rapidly, the time constant fundamentally depending on the distributed capacitances within the further circuit components 9. In order to prevent the voltage VDD from falling too much, the transistor 20 must not be dimensioned to be excessively large. A resistor (not shown) which likewise slows down discharge may also be provided between the source of the transistor 20 and the reference ground potential VSS.

If the operating voltage VDD undershoots the lower limit 24 of the second voltage interval 7, the output of the comparator 17 changes to "1" and stops the clock signal 24 for a short period of time, if appropriate in conjunction with a timer, or interrupts the clock signal, with the result that the current consumption also falls very rapidly.

The comparators 14 and 15 which monitor compliance with the first voltage interval 5 and generate output signals which indicate that the first voltage interval 5 has been left operate in the same manner.

Figure 4:
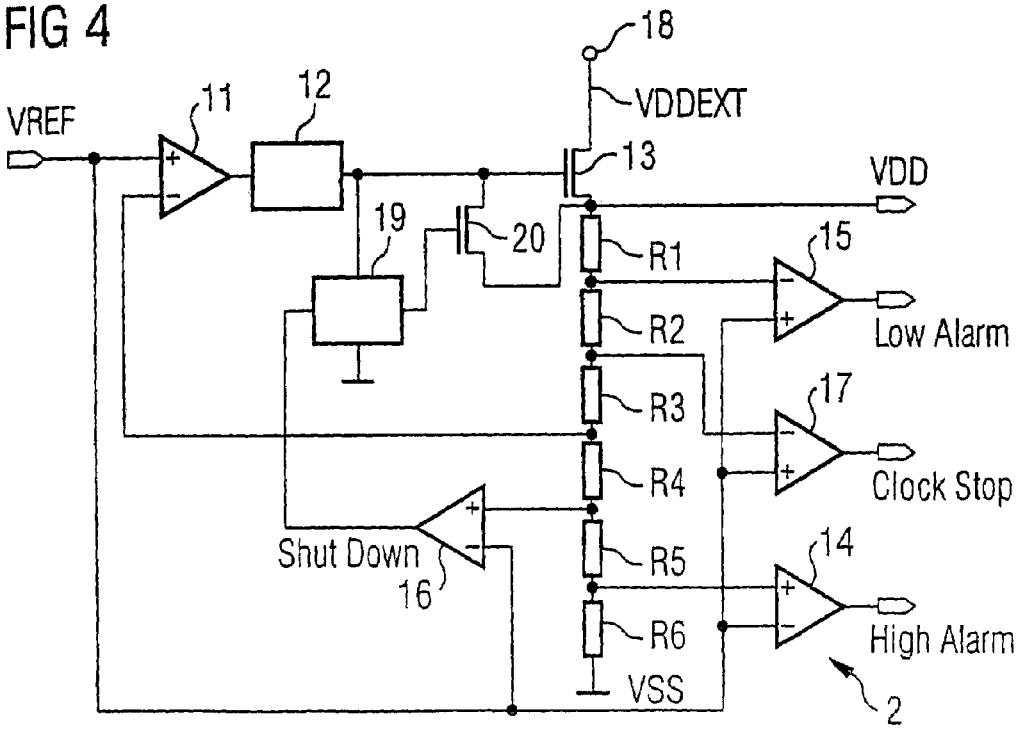
FIG. 4 shows a more detailed illustration of a circuit arrangement according to the invention in a second exemplary embodiment.

FIG. 4 shows a second exemplary embodiment of a circuit arrangement according to the invention which is very similar to the exemplary embodiment of FIG. 3. The difference resides in the arrangement of the transistor 20. The source of the transistor 20, which has a lower threshold voltage than the regulating transistor 13, is connected to the regulated operating voltage VDD. This limits the discharge of the gate of the regulating transistor 13 to the threshold voltage of the transistor 20 and prevents the operating voltage VDD from falling too much.

It goes without saying that other measures which influence the operating voltage in such a manner that compliance with the limits of the first voltage interval 5 is ensured if possible are also conceivable. In this case, however, it must be ensured that the measures are effective quickly enough in order to react to rapid changes in the external supply voltage VDDext and thus to avoid a reset on account of the limits of the first voltage interval 5 being overshot.

What is claimed is:

1. A circuit arrangement comprising:

a voltage regulator, which is designed to generate a regulated operating voltage; and a voltage monitoring unit, which is designed to monitor the regulated operating voltage for deviations from desired values, the voltage monitoring unit comprising:

a first detector, which is designed to cause an alarm signal to be generated when the first detector detects that the regulated operating voltage is outside a first voltage interval; and a second detector, which is designed to cause an initiator to initiate countermeasures which influence the regulated operating voltage when the second detector detects that the regulated operating voltage is outside a second voltage interval, which is inside the first voltage interval.

2. The circuit arrangement as claimed in claim 1, wherein the initiator stops a clock signal for a defined amount of time when the regulated operating voltage is below a lower limit of the second voltage interval.

3. The circuit arrangement as claimed in claim 1, wherein the initiator reduces a clock rate of a clock signal when the regulated operating voltage is below a lower limit of the second voltage interval.

4. The circuit arrangement as claimed in claim 1, wherein the initiator intervenes in the voltage regulator, which intervention causes the regulated operating voltage to be rapidly lowered, when the operating voltage is above an upper limit of the second voltage interval.

5. The circuit arrangement as claimed in claim 1, wherein the initiator activates an additional current load when the operating voltage is above an upper limit of the second voltage interval.

6. The circuit arrangement as claimed in claim 1, wherein the first and second detectors each have two comparators.

7. The circuit arrangement as claimed in claim 1, further comprising a means for resetting the circuit arrangement when the voltage monitoring unit generates an alarm signal.

8. A chip card having a circuit arrangement as claimed in claim 1.

9. A circuit arrangement comprising:

a voltage regulating means for generating a regulated operating voltage; and a voltage monitoring means for monitoring the regulated operating voltage for deviations from desired values, the voltage monitoring means comprising:

a first detecting means for detecting when the regulated operating voltage is outside a first voltage interval, and for causing an alarm signal to be generated when the regulated operating voltage is outside the first voltage interval; and a second detecting means for detecting when the regulated operating voltage is outside a second voltage interval, which is inside the first voltage interval, and for causing an initiating means to initiate countermeasures which influence the regulated operating voltage when the regulated operating voltage is outside the second voltage interval.

10. A method of operating a circuit arrangement, comprising the steps of:

generating a regulated operating voltage; and monitoring the regulated operating voltage for deviations from desired values, the monitoring step comprising the steps of:

generating an alarm signal when the regulated operating voltage is outside a first voltage interval; and initiating countermeasures which influence the regulated operating voltage when the regulated operating voltage is outside a second voltage interval, which is inside the first voltage interval.

11. The method as claimed in claim 10, further comprising the step of stopping a clock signal for a defined amount of time when the regulated operating voltage is below a lower limit of the second voltage interval.

12. The method as claimed in claim 10, further comprising the step of reducing a clock rate of a clock signal when the regulated operating voltage is below a lower limit of the second voltage interval.

13. The method as claimed in claim 10, further comprising the step of intervening in the generation of the regulated operating voltage to cause the regulated operating voltage to be rapidly lowered, when the operating voltage is above an upper limit of the second voltage interval.

14. The method as claimed in claim 10, further comprising the step of activating an additional current load when the operating voltage is above an upper limit of the second voltage interval.

15. The method as claimed in claim 10, further comprising the step of resetting the circuit arrangement when an alarm signal is generated.

* * * * *